US007424807B2

(12) United States Patent
Sienel

(10) Patent No.: US 7,424,807 B2
(45) Date of Patent: Sep. 16, 2008

(54) SUPERCRITICAL PRESSURE REGULATION OF ECONOMIZED REFRIGERATION SYSTEM BY USE OF AN INTERSTAGE ACCUMULATOR

(75) Inventor: Tobias H. Sienel, Manchester, CT (US)

(73) Assignee: Carrier Corporation, Syracuse, NY (US)

( * ) Notice: Subject to any disclaimer, the term of this patent is extended or adjusted under 35 U.S.C. 154(b) by 794 days.

(21) Appl. No.: 10/459,285

(22) Filed: Jun. 11, 2003

(65) Prior Publication Data

US 2004/0250568 A1 Dec. 16, 2004

(51) Int. Cl.
*F25B 41/00* (2006.01)
*F25B 5/00* (2006.01)

(52) U.S. Cl. ..... 62/513; 62/199; 62/503

(58) Field of Classification Search ..... 62/113, 62/115, 117, 498, 504, 513, 529, 199, 503
See application file for complete search history.

(56) References Cited

U.S. PATENT DOCUMENTS 3,423,954 A * 1/1969 Harnish et al. ..... 62/222
4,854,130 A * 8/1989 Naruse et al. ..... 62/352
5,134,859 A * 8/1992 Jaster ..... 62/503
5,245,836 A 9/1993 Lorentzen et al.
6,058,727 A * 5/2000 Fraser et al. ..... 62/190
6,058,729 A * 5/2000 Lifson et al. ..... 62/217
6,138,467 A * 10/2000 Lifson et al. ..... 62/217
6,170,277 B1 * 1/2001 Porter et al. ..... 62/228.3
6,178,761 B1 * 1/2001 Karl ..... 62/159
6,189,335 B1 * 2/2001 Ebara et al. ..... 62/510
6,202,438 B1 * 3/2001 Barito ..... 62/513
6,446,450 B1 * 9/2002 Pressler ..... 62/217
6,474,087 B1 * 11/2002 Lifson ..... 62/199
6,588,223 B2 * 7/2003 Dienhart et al. ..... 62/228.3
6,698,214 B2 * 3/2004 Chordia ..... 62/114
6,701,723 B1 * 3/2004 Dobmeier et al. ..... 62/90

(Continued)

FOREIGN PATENT DOCUMENTS

EP 0 837 291 4/1998

(Continued)

OTHER PUBLICATIONS

International Search Report dated Oct. 26, 2004.

*Primary Examiner*—Cheryl J. Tyler
(74) *Attorney, Agent, or Firm*—Carlson, Gaskey & Olds

(57) ABSTRACT

Refrigerant is circulated through an economized refrigeration system including a compressor, a gas cooler, a main expansion device, an economizer heat exchanger and an evaporator. After cooling, the refrigerant splits into an economizer flow path and a main flow path. Refrigerant in the economizer flow path is expanded to a low pressure and exchanges heat with the refrigerant in the main flow path in the economizer heat exchanger. The refrigerant in the main flow path is then expanded and heated in the evaporator and enters the compressor, completing the cycle. An accumulator positioned between the economizer heat exchanger and the compressor stores excess refrigerant in the system, regulating the amount of refrigerant in the system and the high pressure in the system. The amount of refrigerant in the accumulator is controlled by regulating the economizer expansion device. By adjusting the amount of refrigerant in the accumulator, the amount of refrigerant in the system, and therefore the high pressure of the system, can be regulated.

6 Claims, 2 Drawing Sheets

U.S. PATENT DOCUMENTS

| | | | | |
|---|---|---|---|---|
| 6,718,781 | B2 * | 4/2004 | Freund et al. | 62/199 |
| 6,758,054 | B2 * | 7/2004 | Zheng et al. | 62/199 |

FOREIGN PATENT DOCUMENTS

| | | |
|---|---|---|
| JP | 56 68755 | 6/1981 |
| JP | 08005163 | 1/1996 |
| JP | 10-019421 | 1/1998 |
| JP | 10 318614 | 12/1998 |
| WO | WO99/08053 | 2/1999 |

* cited by examiner

SUPERCRITICAL PRESSURE REGULATION OF ECONOMIZED REFRIGERATION SYSTEM BY USE OF AN INTERSTAGE ACCUMULATOR

BACKGROUND OF THE INVENTION

The present invention relates generally to a system for regulating the high pressure component of an economized refrigeration system by regulating the amount of refrigerant in the high pressure component of the system with an interstage accumulator positioned between an economizer heat exchanger and a compressor.

Chlorine containing refrigerants have been phased out in most of the world due to their ozone destroying potential. Hydrofluoro carbons (HFCs) have been used as replacement refrigerants, but these refrigerants still have high global warming potential. "Natural" refrigerants, such as carbon dioxide and propane, have been proposed as replacement fluids. Unfortunately, there are problems with the use of many of these fluids as well. Carbon dioxide has a low critical point, which causes most air conditioning systems utilizing carbon dioxide to run partially above the critical point, or to run transcritical, under most conditions. The pressure of any subcritical fluid is a function of temperature under saturated conditions (when both liquid and vapor are present). However, when the temperature of the fluid is higher than the critical temperature (supercritical), the pressure becomes a function of the density of the fluid.

When a refrigeration system is run transcritical, it is advantageous to regulate the high pressure component of the system. By regulating the high pressure of the system, the capacity and/or efficiency of the system can be controlled and optimized.

In the prior art, the high pressure component of a refrigeration system has been regulated by adjusting an expansion valve located at the exit of the gas cooler, allowing for control of system capacity and efficiency. Suction line heat exchangers and storage tanks have also been employed to increase system capacity and efficiency.

System capacity can also be increased by employing an economizer heat exchanger to subcool the liquid refrigerant exiting the heat rejecting heat exchanger. The refrigerant is split into two flow paths after leaving the heat rejecting heat exchanger. An economizer flow path is expanded to a low pressure and exchanges heat with a main flow path in the economizer heat exchanger. The refrigerant from the economizer flow path is injected into the compressor. The refrigerant in the main flow path is expanded by the main expansion device. By further cooling the main flow path with the refrigerant in the economizer flow path, the inlet enthalpy to the evaporator decreases, increasing cooling capacity.

SUMMARY OF THE INVENTION

An economized refrigeration system includes a compressor, a gas cooler, a main expansion device, an evaporator, and an economizer heat exchanger. After being cooled in the gas cooler, the refrigerant splits into an economizer flow path and a main flow path. Refrigerant in the economizer flow path is expanded to a lower pressure in an economizer expansion device and exchanges heat with the refrigerant in the main flow path in the economizer heat exchanger. Refrigerant in the economizer flow path is returned to the compressor or between stages of a multiple state compression process. An accumulator positioned between the economizer heat exchanger and the compressor stores an amount of refrigerant from the economizer heat exchanger, adjusting the amount of refrigerant in the system, and therefore the high pressure of the system. Preferably, carbon dioxide is the refrigerant. The refrigerant in the main flow path is expanded by the main expansion device and heated in the evaporator, completing the cycle. By regulating the high pressure of the system, system efficiency and capacity can be optimized.

By regulating the amount of refrigerant stored in the accumulator, and therefore the amount of refrigerant in the system, the high pressure of the system can be regulated. The amount of refrigerant stored in the accumulator is regulated by actuating the economizer expansion device. The high pressure in the gas cooler is monitored by a control which actuates in the economizer expansion device in response to the high pressure of the system.

If the economizer expansion device is opened slightly, more refrigerant flows through the economizer heat exchanger and cools the refrigerant in the main flow path. As the refrigerant in the economizer flow path is not superheated, the liquid refrigerant from the economizer heat exchanger accumulates in the accumulator, decreasing both the amount of refrigerant in the system and the high pressure of the system. If the economizer expansion device is closed slightly, less refrigerant flows through the economizer heat exchanger, increasing superheat of the refrigerant in the economizer flow path. As the refrigerant is superheated, less refrigerant accumulates in the accumulator, increasing the amount of refrigerant in the system and the high pressure in the system. The main expansion device can be used to control the suction superheat after the evaporator or before the first stage of compression.

BRIEF DESCRIPTION OF THE DRAWINGS

The various features and advantages of the invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
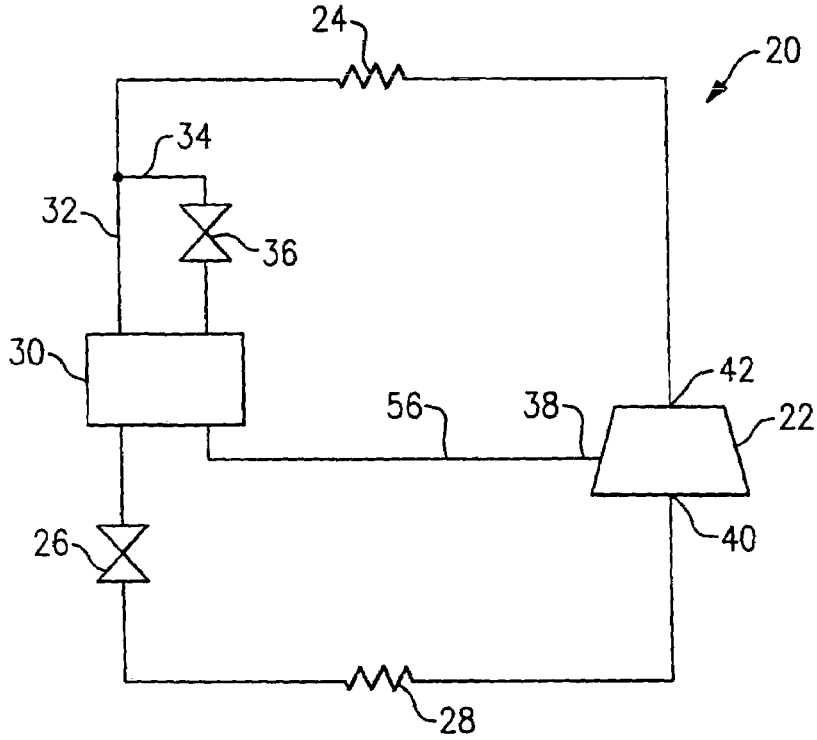
FIG.1 Prior Art
FIG. 1 illustrates a schematic diagram of a prior art refrigeration system employing an economizer heat exchanger.

FIG. 1 schematically illustrates a prior art economized refrigeration system 20. The system 20 includes a compressor 22, a heat rejecting heat exchanger 24 (a gas cooler in transcritical cycles), a main expansion device 26, a heat accepting heat exchanger 28 (an evaporator), and an economizer heat exchanger 30. Refrigerant circulates though the closed circuit system 20. Refrigerant exits the compressor 22 through a discharge port 42 at high pressure and enthalpy. The refrigerant flows through the gas cooler 24 and loses heat, exiting at lower enthalpy and high pressure. The refrigerant then splits into two flow paths 32 and 34. Refrigerant in the economizer flow path 34 is expanded to a low pressure in an economizer expansion device 36 and exchanges heat with refrigerant in the main flow path 32 in the economizer heat exchanger 30, cooling the refrigerant in the main flow path 32. Refrigerant in the economizer flow path 34 is returned along the economizer return path 56 to the compressor 22 through the economizer port 38 at a pressure between the suction pressure and the discharge pressure. The refrigerant in the main flow path 32 expanded by the main expansion device 26 and is then heated in the evaporator 28. The refrigerant then enters the compressor 22 through the suction port 40 and mixes with the refrigerant from the return path 56.

Preferably, carbon dioxide is used as the refrigerant. While carbon dioxide is illustrated, it is to be understood that other refrigerants may be used. Because carbon dioxide has a low critical point, systems utilizing carbon dioxide as the refrigerant usually require the system 20 to run transcritical. When the system 20 is run transcritical, it is advantageous to regulate the high pressure component of the system 20. By regulating the high pressure of the system 20, the capacity and/or efficiency of the system 20 can be controlled and optimized.

Figure 2:
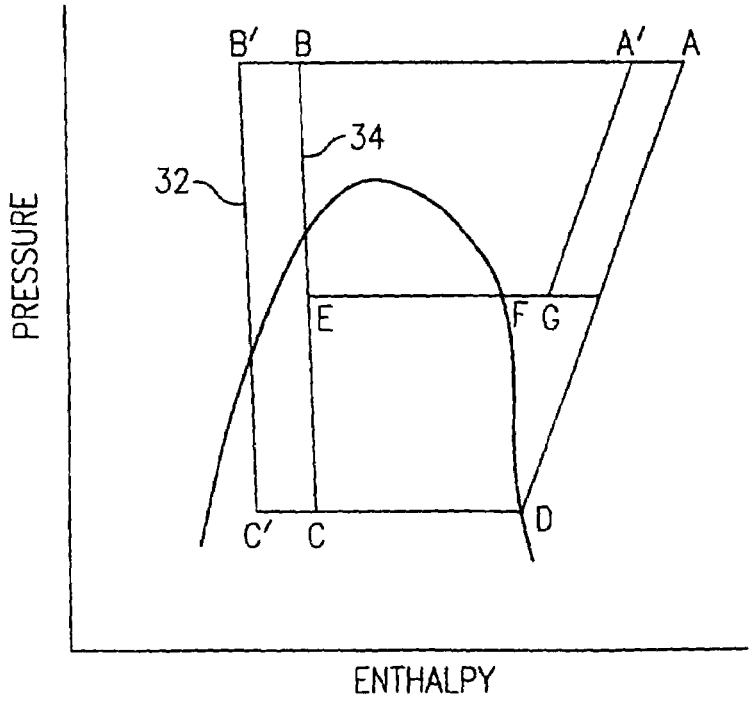
FIG. 2 illustrates a graph relating pressure to enthalpy for an economizer cycle and a non-economizer cycle.

A thermodynamic diagram of both an economized cycle and a noneconomized cycle is illustrated in FIG. 2. In a non-economized system, the refrigerant exits the compressor 22 at high pressure and enthalpy, shown by point A. As the refrigerant flows through the gas cooler 24 at high pressure, it loses heat and enthalpy, exiting the gas cooler 24 with low enthalpy and high pressure, indicated as point B. As the refrigerant passes through the expansion device 26, the pressure drops, shown by point C. After expansion, the refrigerant passes through the evaporator 28 and exits at a high enthalpy and low pressure, represented by point D. After the refrigerant passes through the compressor 22, it is again at high pressure and enthalpy, completing the cycle.

In an economized cycle, the flow exiting the heat rejecting heat exchanger 24 at point B is split into two portions. One portion of the economized flow path 34 is expanded to a lower pressure and temperature, as indicated by point E. This flow next exchanges heat with the main flow path 32 in an economizer heat exchanger 30. The main flow path 32 exits the economizer heat exchanger 30 at point B', while the economizer flow exits at point F. The main flow is next expanded to a lower temperature and pressure, as indicated by point C'. This flow is directed through an evaporator 28 to point D. The main flow is then compressed in a compressor 22. During the compression process, or between stages of a multiple stage compression process, the economizer flow from point F is added, lowering the temperature of the main flow to point G, and causing the compression process to exit at point A' rather than point A, completing the cycle.

The high pressure of the system 20 is a function of temperature and density of the refrigerant in the gas cooler 24. As density is a function of both mass and volume, and the volume inside the gas cooler 24 typically does not change, the high pressure in the gas cooler 24 is only a function of the refrigerant mass and temperature in the gas cooler 24. Therefore, by controlling the mass of refrigerant in the gas cooler 24, the high pressure of the system 20 can be regulated.

Figure 3:
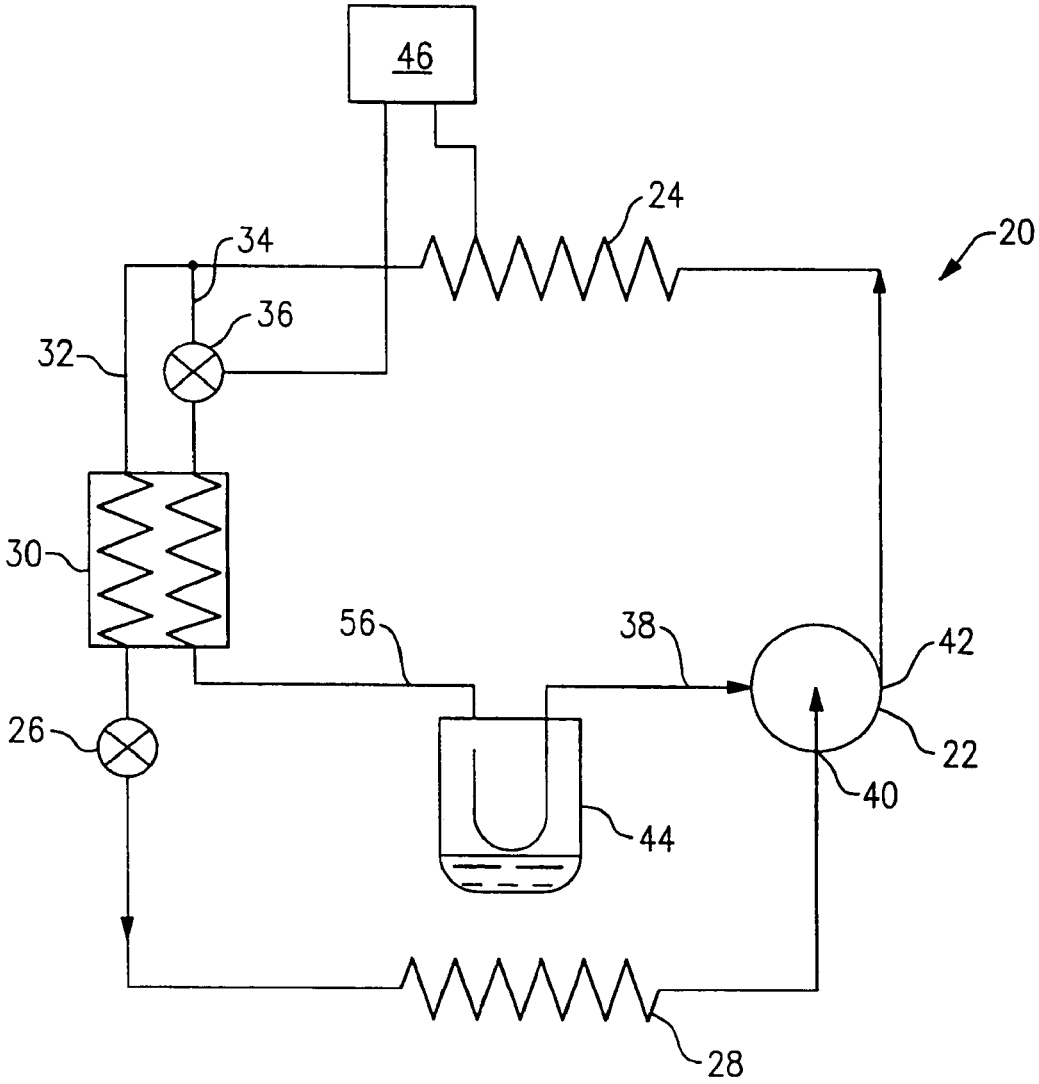
FIG. 3 illustrates the economized system of the present invention employing an accumulator.

FIG. 3 illustrates the system 20 of the present invention. The system 20 further includes an interstage accumulator 44 positioned between the economizer heat exchanger 30 and the economizer port 38 of the compressor 22 to store refrigerant. If the net flow of refrigerant in the system 20 is into the accumulator 44, there is less refrigerant circulated through the system, and the gas cooler 24 pressure will decrease if the suction superheat is maintained as constant. Alternately, if the net flow of refrigerant in the system 20 is out of the accumulator 44, there is more refrigerant circulating through the system 20, and the gas cooler 24 pressure will increase if the suction superheat is maintained as constant.

The main expansion device 26 regulates the main flow path 32 flowing to the evaporator 28, and therefore the suction superheat of the compressor 22. If the main expansion device 26 is opened slightly, more refrigerant flows through the evaporator 28, and the superheat at the compressor 22 suction decreases. If the main expansion device 26 is closed slightly, less refrigerant flows through the evaporator 28, and the superheat at the suction port 40 of the compressor 22 increases.

The economizer expansion device 36 regulates the economizer flow path 34 and therefore the high pressure in the system 20. The amount of superheat in the economizer return path 56 is regulated by both the initial sizing of the economizer heat exchanger 30 and the flow of refrigerant through the economizer flow path 34, which is regulated by the economizer expansion device 36. If the superheat in the economizer return path 56 is positive, there will be a net flow of refrigerant out of the accumulator 44 which will cause the high pressure to rise. By adjusting the economizer expansion device 36, the amount of refrigerant in the accumulator 44, and therefore the high pressure in the system 20, can be regulated.

If the economizer expansion device 36 is opened slightly, more refrigerant flows through the economizer heat exchanger 30 and cools the refrigerant in the main flow path 32, decreasing superheat at the economizer port 38. The amount of refrigerant in the system 20 decreases, decreasing the high pressure of the system 20.

Even if liquid refrigerant accumulates in the accumulator 44, the compressor 22 will continue to draw refrigerant from the accumulator 44. Therefore, the economizer return path 56 exiting the economizer heat exchanger 30 must be saturated to maintain a balance between the flow entering the accumulator 44 and the flow exiting the accumulator 44. If the flow is saturated, the quality of the economizer heat exchanger 30 flow will decrease, causing refrigerant to flow into the accumulator 44, decreasing the high pressure. If the flow is not saturated, the refrigerant in the gas cooler 24 will eventually flow from the accumulator 44 and into the system 20, increasing the high pressure.

If the economizer expansion device 36 is closed slightly, less refrigerant flows through the economizer heat exchanger 30, increasing superheat of the refrigerant in the economizer 44ewreturn path 56. As the refrigerant in the economizer return path 56 is superheated, less refrigerant accumulates in the accumulator 44, increasing the amount of refrigerant in the system 20 and the high pressure in the system 20.

The high pressure in the gas cooler 24 is monitored by a control 46. If the control 46 detects the high pressure in the gas cooler 24 is too high, the control 46 opens the economizer expansion device 36 to allow refrigerant from the gas cooler 24 to flow through the economizer heat exchanger 30 and enter the accumulator 44, decreasing the high pressure. Alternately, if the control 46 detects the high pressure in the gas cooler 24 is too low, the control 46 closes the economizer expansion device 36 to prevent refrigerant from the gas cooler 24 to flow through the economizer heat exchanger 30 and enter the accumulator 44, increasing the high pressure.

The superheat at the exit of the evaporator 28 is also regulated by a control of the main expansion device 26, either through thermomechanical means, such as a TXV valve, or by regulation of a sensor. Although it has been illustrated and described that the main flow path 32 and the economized flow path 34 are split prior to passing through the economizer heat exchanger 30, it is to be understood that the entire flow exiting the gas cooler 24 can also pass through the economizer heat exchanger 30 before being split into the main flow path 32 and the economized flow path 34.

It is also be to understood that while a single compressor 22 has been illustrated and described, a multiple compression stage system can also be employed where multiple compressors are utilized.

The foregoing description is only exemplary of the principles of the invention. Many modifications and variations of the present invention are possible in light of the above teachings. The preferred embodiments of this invention have been disclosed, however, so that one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

What is claimed is:

1. A refrigeration system comprising:

a compressor for compressing a refrigerant to a high pressure, said compressor including a suction port and an economizer port;

a heat rejecting heat exchanger for cooling said refrigerant;

an economizer heat exchanger, said refrigerant being split into a main passage and an economized passage, and said refrigerant in said economized passage is reduced to a low pressure in an economizer expansion device and exchanges heat with said refrigerant in said main passage in said economizer heat exchanger, said economized passage returning to said economizer port of said compressor along an economizer return line;

an accumulator positioned between said economizer heat exchanger and said compressor for storing an amount of charge, and said accumulator is located on said economizer return line;

a main expansion device for reducing said refrigerant in said main passage to a low pressure;

a heat accepting heat exchanger for evaporating said refrigerant, and said refrigerant from said heat accepting heat exchanger enters said compressor through said suction port; and a control that monitors said high pressure in said system, wherein said control opens said economizer expansion device when said control detects that said high pressure in said system is above a desired high pressure to decrease said high pressure.

2. The system as recited in claim 1 wherein said refrigerant is carbon dioxide.

3. The system as recited in claim 1, wherein said accumulator adjusts said amount of said charge in the refrigeration system.

4. The system as recited in claim 1 wherein said accumulator is positioned between said economizer heat exchanger and said economizer port of said compressor.

5. A refrigeration system comprising:

a compressor for compressing a refrigerant to a high pressure, said compressor including a suction port and an economizer port;

a heat rejecting heat exchanger for cooling said refrigerant;

an economizer heat exchanger, said refrigerant being split into a main passage and an economized passage, and said refrigerant in said economized passage is reduced to a low pressure in an economizer expansion device and exchanges heat with said refrigerant in said main passage in said economizer heat exchanger, said economized passage returning to said economizer port of said compressor along an economizer return line;

an accumulator positioned between said economizer heat exchanger and said compressor for storing an amount of charge, and said accumulator is located on said economizer return line;

a main expansion device for reducing said refrigerant in said main passage to a low pressure;

a heat accepting heat exchanger for evaporating said refrigerant, and said refrigerant from said heat accepting heat exchanger enters said compressor through said suction port; and a control that monitors said high pressure in said system, wherein said control closes said economizer expansion device when said control detects that said high pressure in said system is below a desired high pressure to increase said high pressure.

6. A method of regulating a high pressure of a refrigeration system comprising the steps of:

compressing a refrigerant to the high pressure with a compressor;

cooling the refrigerant;

splitting the refrigerant into a first portion that flows along a main passage and a second portion that flows along an economized passage;

expanding the second portion of the refrigerant in the economized passage;

exchanging heat between the first portion of the refrigerant in the main passage and the second portion of the refrigerant in the economized passage;

returning the second portion of the refrigerant in the economized passage to the compressor along a return line;

storing an amount of charge flowing along the return line;

expanding the first portion of the refrigerant in the main passage to a low pressure;

evaporating the first portion of the refrigerant; and adjusting the amount of the charge from the step of storing to regulate the high pressure of the system.

* * * * *